US006278955B1

(12) United States Patent
Hartman et al.

(10) Patent No.: US 6,278,955 B1
(45) Date of Patent: Aug. 21, 2001

(54) METHOD FOR AUTOMATICALLY POSITIONING THE BLADE OF A MOTOR GRADER TO A MEMORY POSITION

(75) Inventors: Matthew A. Hartman, Bloomington; Mark D. Shane, Princeville; Daniel E. Shearer, Metamora; Xiaojun Zhang, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/208,357

(22) Filed: Dec. 10, 1998

(51) Int. Cl.[7] ..... G06F 19/00; E02F 3/00

(52) U.S. Cl. ..... 702/105; 702/95; 701/50; 701/51; 172/91; 172/92

(58) Field of Search ..... 702/94–95, 105, 702/152, 154–155; 700/302, 303, 304; 701/29, 50–51; 172/4.5, 91–92, 814–815

(56) References Cited

U.S. PATENT DOCUMENTS

| | | | |
|---|---|---|---|
| 4,136,508 | 1/1979 | Coleman et al. . | |
| 4,185,700 | 1/1980 | Atherton et al. . | |
| 4,221,266 | 9/1980 | Fardal . | |
| 4,286,386 | 9/1981 | Long | 33/138 |
| 4,288,196 | 9/1981 | Sutton, II | 414/699 |
| 4,646,620 | 3/1987 | Buchl | 91/1 |
| 4,733,310 | 3/1988 | Kapp et al. . | |
| 4,733,355 | 3/1988 | Davidson et al. . | |
| 4,744,218 | 5/1988 | Edwards et al. . | |
| 4,912,643 | 3/1990 | Beirxe | 364/449 |
| 4,918,608 | 4/1990 | Middleton et al. | 364/424.07 |
| 4,934,463 | 6/1990 | Ishida et al. | 172/4.5 |
| 4,955,437 | 9/1990 | Bohman . | |
| 5,065,326 | 11/1991 | Sahm | 364/424.07 |
| 5,078,215 | 1/1992 | Nau . | |
| 5,170,342 | 12/1992 | Nakamura et al. | 364/167.01 |
| 5,274,557 | 12/1993 | Moriya et al. | 364/424.07 |
| 5,327,345 * | 7/1994 | Nielsen et al. | 172/4.5 |
| 5,356,259 | 10/1994 | Hanamoto et al. . | |
| 5,430,651 * | 7/1995 | Nielsen et al. | 701/50 |
| 5,499,684 * | 3/1996 | Stratton | 701/50 |
| 5,551,518 * | 9/1996 | Stratton | 701/50 |
| 5,631,658 | 5/1997 | Gudat et al. . | |
| 5,647,439 | 7/1997 | Burdick et al. . | |
| 5,667,020 | 9/1997 | Palmer et al. . | |
| 5,735,352 | 4/1998 | Henderson et al. . | |
| 5,894,894 | 4/1999 | Szymczak . | |
| 5,905,986 | 5/1999 | Rohrbaugh et al. . | |
| 5,947,225 | 9/1999 | Kawakami et al. . | |
| 5,951,612 | 9/1999 | Sahm . | |
| 5,987,371 | 11/1999 | Bailey et al. . | |
| 6,032,093 * | 2/2000 | Denbraber et al. | 700/302 |

FOREIGN PATENT DOCUMENTS

| | | |
|---|---|---|
| 1390066 | 4/1975 | (GB) . |
| 57-071939 | 5/1982 | (JP) . |
| 58-164835 | 9/1983 | (JP) . |
| 59-102023 | 6/1984 | (JP) . |

* cited by examiner

*Primary Examiner*—Patrick Assouad
*Assistant Examiner*—Bryan Bui
(74) *Attorney, Agent, or Firm*—Kevin M. Kercher

(57) ABSTRACT

A system and method for automatically adjusting the blade of a motor grader to an operator programmed blade position. The method includes the steps of: providing an electronic controller and blade controls having position sensors; monitoring the output of the position sensors to ascertain the position of the blade controls; receiving a first input signal for setting a memory blade position; determining the memory blade position based on the output of the position sensors; receiving a second input signal for requesting the memory blade position; determining the present blade position based on the output of the position sensors; and producing a control signal for actuating the blade controls to move the blade from the present blade position to the memory blade position.

5 Claims, 4 Drawing Sheets

METHOD FOR AUTOMATICALLY POSITIONING THE BLADE OF A MOTOR GRADER TO A MEMORY POSITION

TECHNICAL FIELD

This invention relates generally to a method for automatically positioning the blade of a motor grader to a memory position and, more particularly, to a method for automatically adjusting the blade to an operator programmed blade position.

BACKGROUND ART

Motor graders are used primarily as a finishing tool to sculpt a surface of earth to a final arrangement. To perform such earth sculpting tasks, motor graders include a blade, also referred to as a moldboard or implement. The blade moves relatively small quantities of earth from side to side. Motor graders must produce a variety of final earth arrangements. As a result, the blade must be set to many different blade positions.

The blade may be adjusted for blade height, blade cutting angle, blade tip, blade sideshift, and drawbar sideshift. Accordingly, motor graders include several hand controls to operate the multiple blade adjustments. Positioning the blade of a motor grader is a complex and time consuming task. Frequently, an operator will desire one or more unique blade positions. Thus, to improve efficiency and consistency, it is desirable to provide a method for automatically positioning the blade of a motor grader to an operator programmed blade position.

The present invention is directed to overcoming one or more of the problems as set forth above.

DISCLOSURE OF THE INVENTION

The present invention provides a method for automatically positioning the blade of a motor grader to a memory position. The method includes the steps of: providing an electronic controller and blade controls having position sensors; monitoring the output of the position sensors to ascertain the position of the blade controls; receiving a first input signal for setting a memory blade position; determining the memory blade position based on the output of the position sensors; receiving a second input signal for requesting the memory blade position; determining the present blade position based on the output of the position sensors; and producing a control signal for actuating the blade controls to move the blade from the present blade position to the memory blade position.

BRIEF DESCRIPTION OF THE DRAWINGS

Other advantages of the present invention will be readily appreciated as the same becomes better understood by reference to the following detailed description when considered in connection with the accompanying drawings wherein.

BEST MODE FOR CARRYING OUT THE INVENTION

Figure 1:
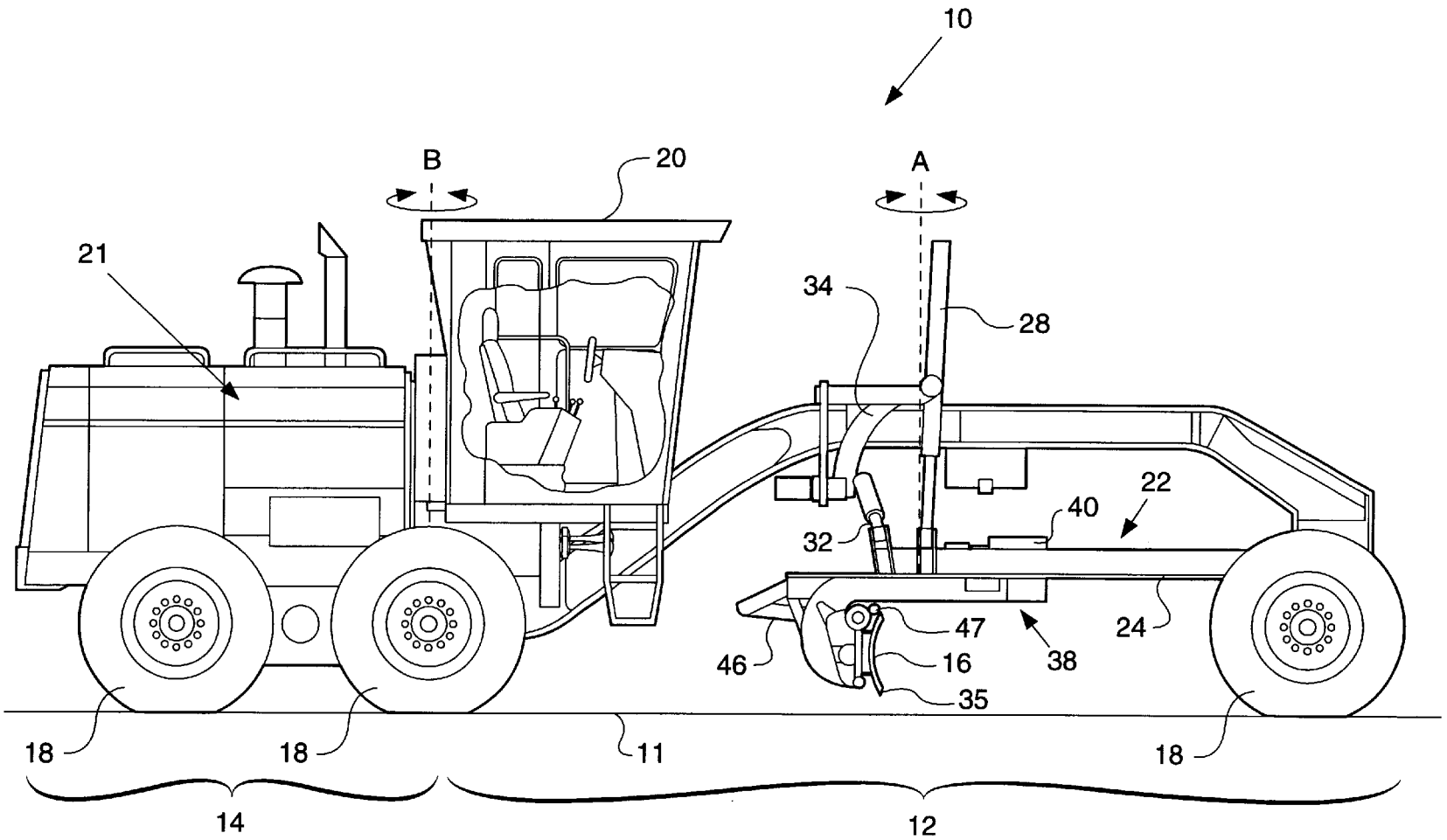
FIG. 1 is a side view of a motor grader.
Figure 2:
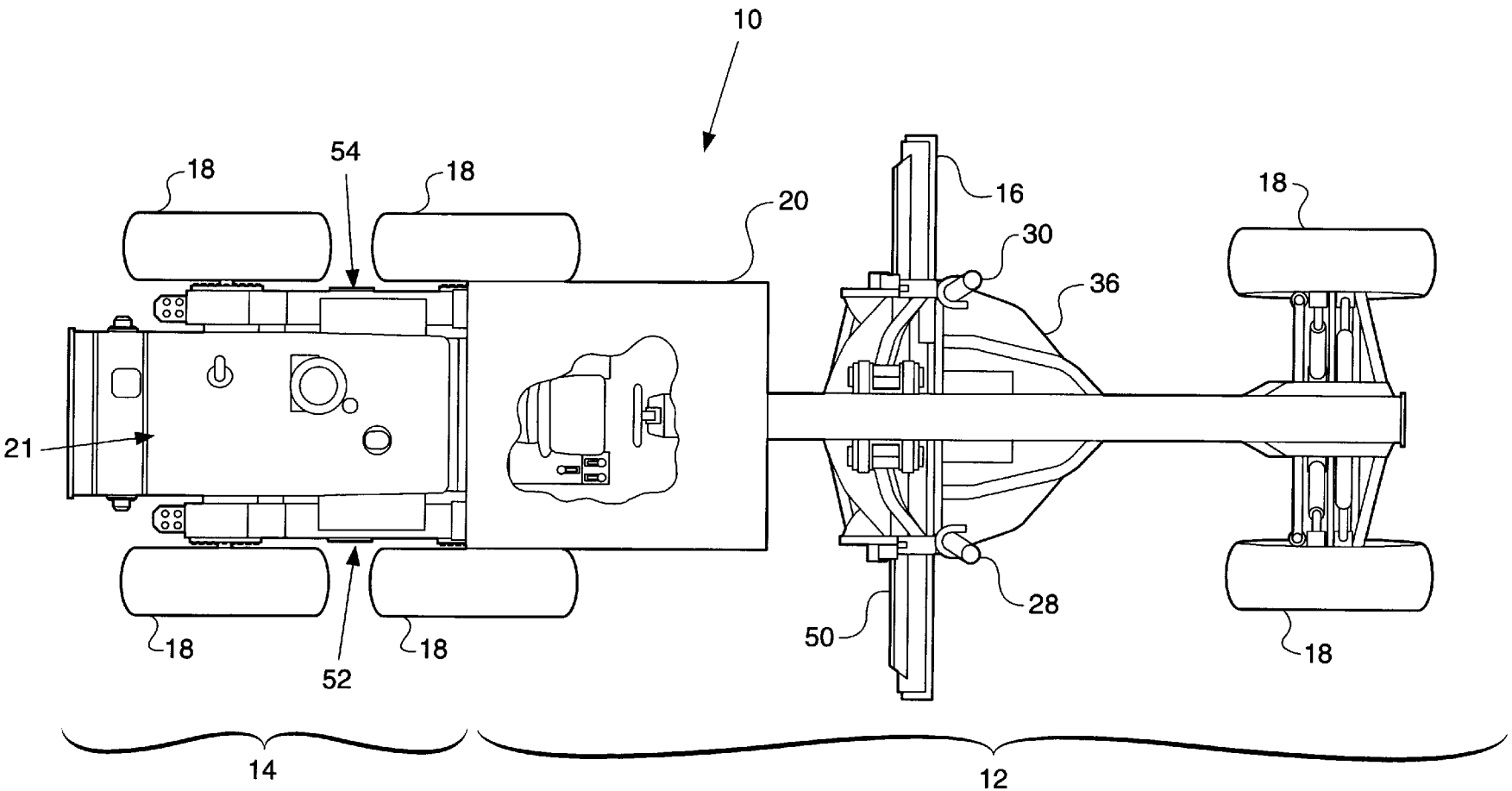
FIG. 2 is a top view of the motor grader.

Referring to the Figures, wherein like numerals indicate like or corresponding parts throughout the several views, a motor grader is shown generally at 10 in FIGS. 1 and 2. The motor grader 10 is used primarily as a finishing tool to sculpt a surface of earth 11 to a final arrangement. Rather than moving large quantities of earth in the direction of travel like other machines, such as a bulldozer, the motor grader 10 typically moves relatively small quantities of earth from side to side. In other words, the motor grader 10 typically moves earth across the area being graded, not straight ahead.

The motor grader 10 includes a front frame 12, a rear frame 14, and a blade 16. The front and rear frames 12 and 14 are supported by tires 18. An operator cab 20 containing the many controls necessary to operate the motor grader 10 is mounted on the front frame 12. An engine, shown generally at 21, is used to drive or power the motor grader 10. The engine 21 is mounted on the rear frame 14. The blade 16, sometimes referred to as a moldboard, is used to move earth. The blade 16 is mounted on a linkage assembly, shown generally at 22. The linkage assembly 22 allows the blade 16 to be moved to a variety of different positions relative to the motor grader 10. Starting at the front of the motor grader 10 and working rearward toward the blade 16, the linkage assembly 22 includes a drawbar 24.

The drawbar 24 is mounted to the front frame 12 with a ball joint. The position of the drawbar 24 is controlled by three hydraulic cylinders, commonly referred to as a right lift cylinder 28, a left lift cylinder 30, and a center shift cylinder 32. A coupling, shown generally at 34, connects the three cylinders 28, 30, and 32 to the front frame 12. The coupling 34 can be moved during blade repositioning but is fixed stationary during earthmoving operations. The height of the blade 16 with respect to the surface of earth 11 below the motor grader 10, commonly referred to as blade height, is controlled primarily with the right and left lift cylinders 28 and 30. The right and left lift cylinders 28 and 30 can be controlled independently and, thus, used to angle a bottom cutting edge 35 of the blade 16 relative to the surface of earth 11. The center shift cylinder 32 is used primarily to sideshift the drawbar 24, and all the components mounted to the end of the drawbar, relative to the front frame 12. This sideshift is commonly referred to as drawbar sideshift or circle centershift.

Figure 3:
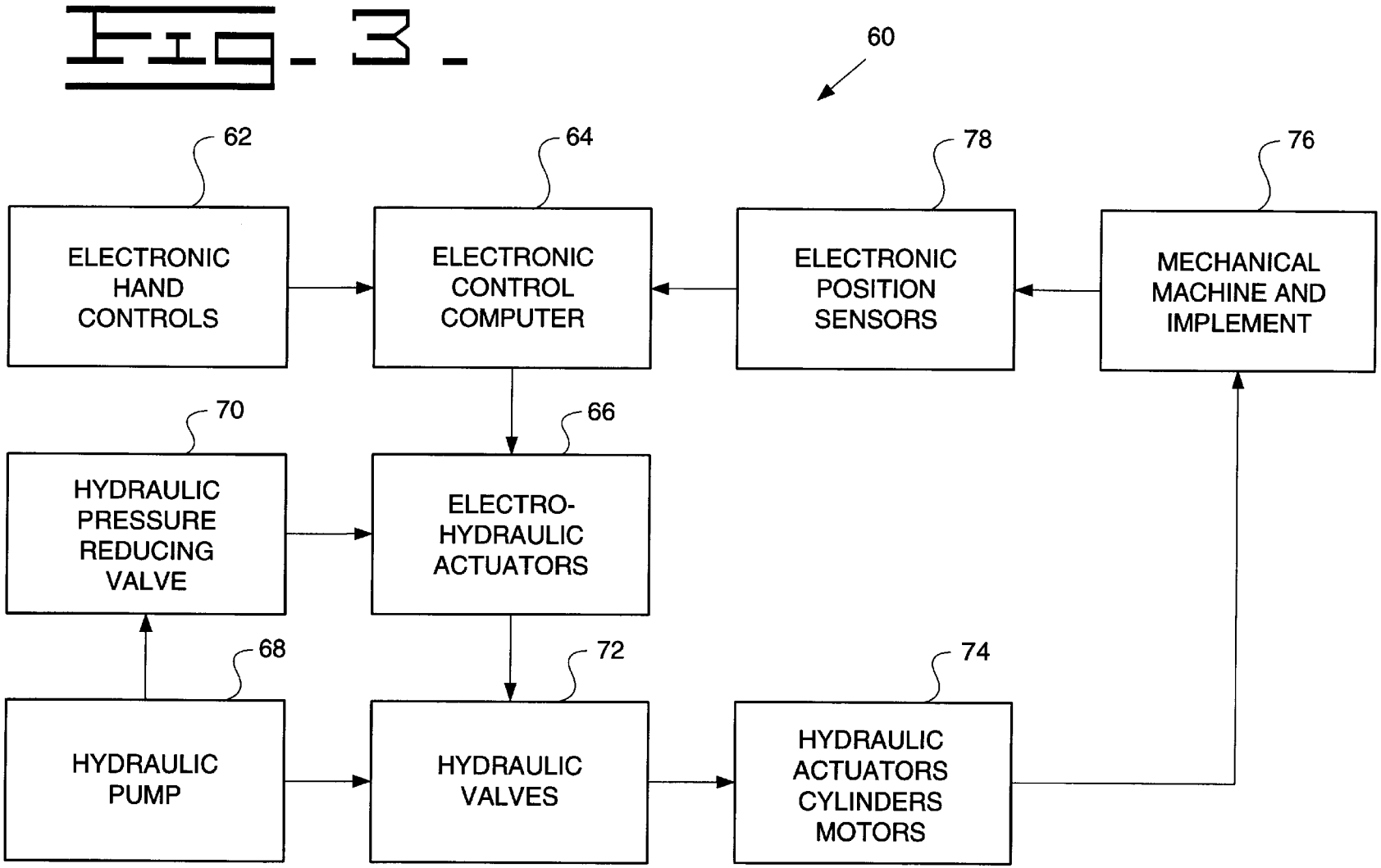
FIG. 3 is a schematic block diagram of an electro-hydraulic control system for the motor grader.

The drawbar 24 includes a large, flat plate, commonly referred to as a yoke plate 36, as shown in FIGS. 2 and 3. Beneath the yoke plate 36 is a large gear, commonly referred to as a circle 38. The circle 38 is rotated by a hydraulic motor, commonly referred to as a circle drive 40, as shown in FIG. 2. The rotation of the circle 38 by the circle drive 40, commonly referred to as circle turn, pivots the blade 16 about an axis A fixed to the drawbar 24 to establish a blade cutting angle. The blade cutting angle is defined as the angle of the blade 16 relative to the front frame 12. At a 0 degree blade cutting angle, the blade 16 is aligned at a right angle to the front frame 12.

The blade 16 is mounted to a hinge on the circle 38 with a bracket. A blade tip cylinder 46 is used to pitch the bracket forward or rearward. In other words, the blade tip cylinder 46 is used to tip a top edge 47 of the blade 16 ahead of or behind the bottom cutting edge 35 of the blade 16. The position of the top edge 47 of the blade 16 relative to the bottom cutting edge 35 of the blade 16 is commonly referred to as blade tip.

The blade 16 is mounted to a sliding joint in the bracket allowing the blade 16 to be slid or shifted from side to side relative to the bracket or the circle 38. This side to side shift is commonly referred to as blade side shift. A side shift cylinder 50 is used to control the blade sideshift.

Referring now to FIG. 2, a right articulation cylinder, shown generally at 52, is mounted to the right side of the rear frame 14 and a left articulation cylinder, shown generally at 54, is mounted to the left side of the rear frame 14. The right and left articulation cylinders 52 and 54 are used to rotate the front frame 12 about an axis B shown in FIG. 1. The axis B is commonly referred to as the articulation axis. In FIG. 2, the motor grader 10 is positioned in a neutral or zero articulation angle.

FIG. 3 is a schematic block diagram of an electro-hydraulic control system 60 for the motor grader 10. The control system 60 is designed to control the blade 16 and the articulation angle q. The system 60 includes electronic hand controls, represented by block 62, which transform the actions of an operator's hands into electrical input signals. These input signals carry operational information to an electronic control computer, represented by block 64.

The control computer 64 receives the electrical inputs signals produced by the hand controls 62, processes the operational information carried by the input signals, and transmits control signals to drive solenoids in electro-hydraulic actuators, represented by block 66.

The hydraulic portion of the control system 60 requires both high hydraulic pressure and low pilot pressure. High hydraulic pressure is provided by a hydraulic pump, represented by block 68. The hydraulic pump 68 receives a rotary motion, typically from the engine 21 of the motor grader 10, and produces high hydraulic pressure. Low pilot pressure is provided by a hydraulic pressure reducing valve, represented by block 70. The hydraulic pressure reducing valve 70 receives high hydraulic pressure from the hydraulic pump 68 and supplies low pilot pressure to the electro-hydraulic actuators 66.

Each electro-hydraulic actuator 66 includes an electrical solenoid and a hydraulic valve. The solenoid receives control signals from the electronic control computer 64 and produces a controlled mechanical movement of a core stem of the actuator 66. The hydraulic valve receives both the controlled mechanical movement of the core stem of the actuator 66 and low pilot pressure from the hydraulic pressure reducing valve 70 and produces controlled pilot hydraulic pressure for hydraulic valves, represented by block 72.

The hydraulic valves 72 receive both controlled pilot hydraulic pressure from the electro-hydraulic actuators 66 and high hydraulic pressure from the hydraulic pump 68 and produce controlled high hydraulic pressure for hydraulic actuators, cylinders, and motors, represented by block 74.

The hydraulic actuators, cylinders, and motors 74 receive controlled high hydraulic pressure from the hydraulic valves 72 and produce mechanical force to move the front frame 12 of the grader 10 and several mechanical linkages, represented by block 76. As described above, movement of the front frame 12 of the grader 10 with respect to the rear frame 14 of the grader 10 establishes the articulation angle q. Movement of the mechanical linkages establishes the position of the blade 16.

Each hydraulic actuator, cylinder, and motor 74, such as the lift cylinders 28 and 30 and the circle drive motor 40, includes an electronic position sensor, represented by block 78. The electronic position sensors 78 transmit information regarding the position of its respective hydraulic actuator, cylinder, or motor 76 to the electronic control computer 64. In this mariner, the control computer 64 can determine the position of the blade 16. The control computer 64 further receives articulation angle information from the rotary sensor, also represented by block 78, positioned at the articulation joint 56. With such position and angle information, the control computer 64 can perform additional operations.

In accordance with the scope of the present invention, one such operation is automatically adjusting the blade 16 of the motor grader 10 to an operator programmed blade position. Thus, the present invention provides a method for automatically positioning the blade 16 of the motor grader 10 to a memory position. The method includes the steps of: providing an electronic controller and blade controls having position sensors; monitoring the output of the position sensors to ascertain the position of the blade controls; receiving a first input signal for setting a memory blade position; determining the memory blade position based on the output of the position sensors; receiving a second input signal for requesting the memory blade position; determining the present blade position based on the output of the position sensors; and producing a control signal for actuating the blade controls to move the blade from the present blade position to the memory blade position.

In a first embodiment, the electronic controller includes a memory, the step of determining the memory blade position includes determining the three-dimensional coordinates of the memory blade position, and the step of determining the present blade position includes determining the three-dimensional coordinates of the present blade position. The method further includes the steps of: storing in the memory information identifying the three-dimensional coordinates of the memory blade position and retrieving from the memory information identifying the three-dimensional coordinates of the memory blade position.

In a second embodiment, the electronic controller includes a memory and the method further includes the steps of: storing in the memory information identifying the position of the blade controls when the blade is fixed in the memory blade position and retrieving from the memory information indicating the position of the blade controls necessary to achieve the memory blade position.

Figure 4:
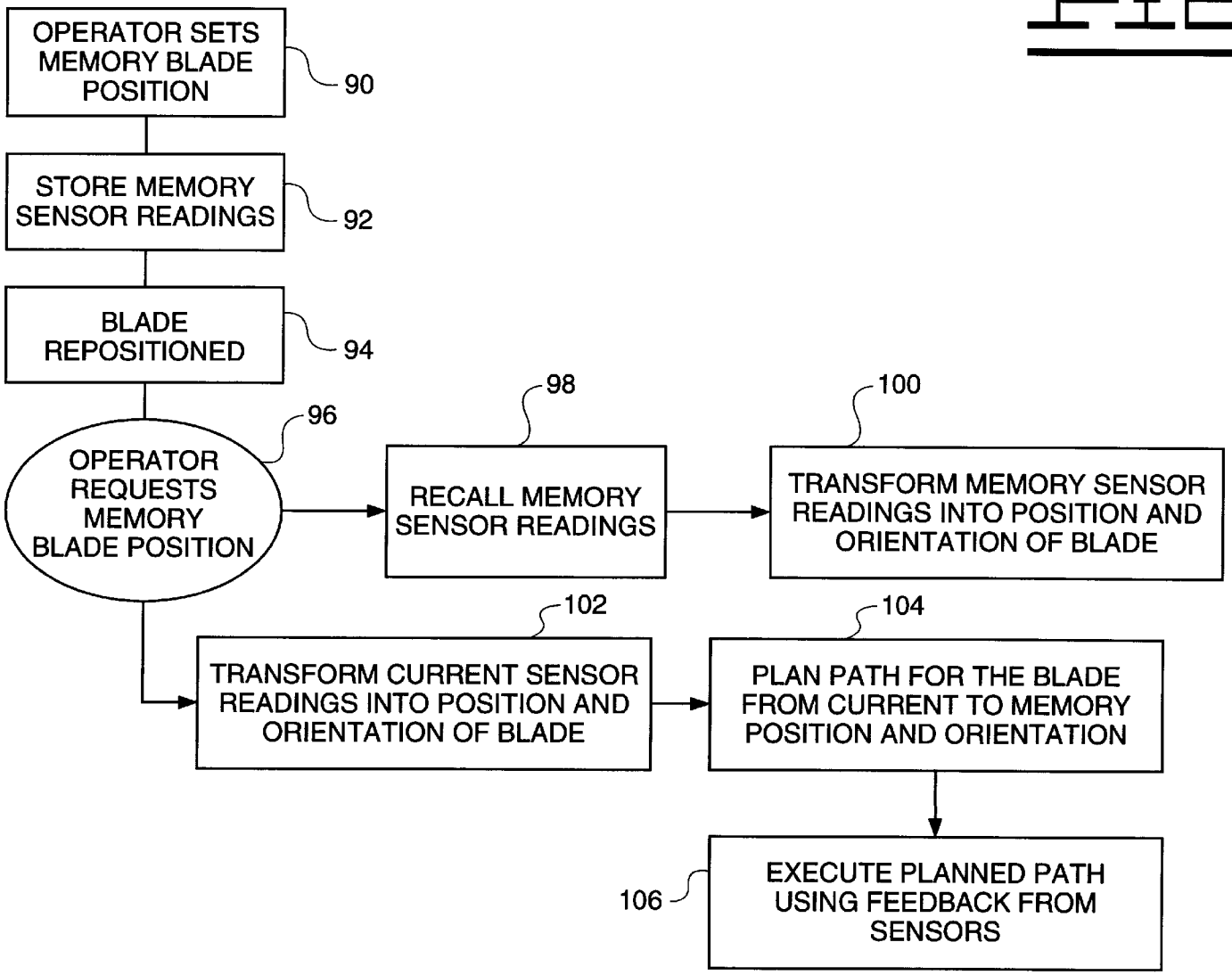
FIG. 4 is a flow chart illustrating a method for automatically positioning the blade of the motor grader to a memory position in accordance with the present invention.

Referring now to FIG. 4, a flow chart illustrating a preferred method for automatically positioning the blade of the motor grader to a memory position is shown. As will be appreciated by one of ordinary skill in the art, although the flow chart illustrates sequential steps, the particular order of processing is not important to achieving the objects of the present invention. As will also be recognized, the method illustrated may be performed in software, hardware, or a combination of both as in a preferred embodiment of the present invention.

In the preferred method, an operator sets a memory blade position by transmitting a first input signal, as represented by block 90. Upon receipt of the first input signal, the sensor readings are stored in the controller as memory sensor readings, as illustrated by block 92. Over time, the blade is repositioned as the motor grader is used to sculpt a surface of earth, as represented by block 94. The operator requests the memory blade position by transmitting a second input signal, as illustrated by block 96. As a result of this request, the controller recalls the memory sensor readings, as represented by block 98, and transforms the memory sensor readings into a memory blade position and orientation, as illustrated by block 100. The controller transforms the current sensor readings into a current blade position and orientation, as represented by block 102. With this positional information, the controller plans a path to move the blade from its current blade position and orientation to the memory or operator programmed position and orientation, as illustrated by block 104. The controller executes the planned path by actuating the blade controls and monitoring feedback from the position sensors, as represented by block 106.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

Industrial Applicability

The present invention relates generally to a method for automatically adjusting the blade of a motor grader, having an electronic controller and blade controls including position sensors, to an operator programmed blade position. By monitoring the output of the position sensors, the controller can ascertain the position of the blade controls. Upon receipt of a first input signal for setting a memory blade position, the controller determines the memory blade position based on the output of the position sensors. Upon receipt of a second input signal for requesting the memory blade position, the controller determines the present blade position based on the output of the position sensor and produces a unique control signal to actuate the blade controls and, thereby, automatically move the blade from its present blade position to the memory blade position. Frequently, an operator will desire one or more unique blade positions. In this manner, the operator can set a memory blade position by simply transmitting the first input signal. Thereafter, the operator can automatically adjust the blade to the memory blade position by simply transmitting the second input signal.

Other aspects, objects, and features of the present invention can be obtained from a study of the drawings, the disclosure, and the appended claims.

What is claimed is:

1. A method for automatically positioning the blade of a motor grader to a memory position comprising the steps of:

providing an electronic controller and blade controls having position sensors;

monitoring the output of the position sensors to ascertain the position of the blade controls;

receiving a first input signal for setting a three-dimensional coordinate memory blade position;

determining the three-dimensional coordinate memory blade position based on the output of the position sensors;

receiving a second input signal for requesting the memory blade position;

determining the present three-dimensional coordinate blade position based on the output of the position sensors; and producing a control signal for actuating blade controls to move the blade from the present three-dimensional coordinate blade position to the memory three-dimensional coordinate blade position.

2. A method as set forth in claim 1 wherein the electronic controller includes a memory and including the step of retrieving from the memory information identifying the three-dimensional coordinates of the memory blade position.

3. A method as set forth in claim 2 including the step of storing in the memory information identifying the three-dimensional coordinates of the memory blade position.

4. A method as set forth in claim 1 wherein the electronic controller includes a memory and including the step of retrieving from the memory information indicating the position of the blade controls necessary to achieve the memory blade position.

5. A method as set forth in claim 4 including the step of storing in the memory information identifying the position of the blade controls when the blade is fixed in the memory blade position.

* * * * *